US010280712B2

(12) United States Patent
Bacsik et al.

(10) Patent No.: US 10,280,712 B2
(45) Date of Patent: May 7, 2019

(54) HYDRAULICALLY ACTUATED FLUID COMMUNICATION MECHANISM

(71) Applicant: Weatherford Technology Holdings, LLC, Houston, TX (US)

(72) Inventors: Ryan R. Bacsik, Houston, TX (US); Cesar G. Garcia, Houston, TX (US); Matthew Priesmeyer, Houston, TX (US); Dick S. Gonzalez, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 15/437,492

(22) Filed: Feb. 21, 2017

(65) Prior Publication Data

US 2017/0241238 A1 Aug. 24, 2017

Related U.S. Application Data

(60) Provisional application No. 62/299,525, filed on Feb. 24, 2016.

(51) Int. Cl.
*E21B 34/10* (2006.01)
*E21B 34/14* (2006.01)
(Continued)

(52) U.S. Cl.
CPC ..... *E21B 34/14* (2013.01); *E21B 34/10* (2013.01); *E21B 43/14* (2013.01); *E21B 43/08* (2013.01);
(Continued)

(58) Field of Classification Search
CPC ..... E21B 34/00; E21B 34/10; E21B 34/14
See application file for complete search history.

(56) References Cited

U.S. PATENT DOCUMENTS 6,065,541 A * 5/2000 Allen ..... E21B 23/04 166/222
8,276,674 B2 10/2012 Lopez de Cardenas et al.
(Continued)

FOREIGN PATENT DOCUMENTS

GB 2522272 A 7/2015
WO 2009029437 A1 3/2009

OTHER PUBLICATIONS

Combined Search and Examination Report in counterpart GB Application No. GB1703007.3, dated Jun. 21, 2017, 6 Pages.
(Continued)

*Primary Examiner* — D. Andrews
*Assistant Examiner* — Dany E Akakpo
(74) *Attorney, Agent, or Firm* — Blank Rome LLP

(57) ABSTRACT

A completion apparatus for a wellbore includes several flow tools and an actuation mechanism. The flow tools have a piston defining first and second chambers with a housing. The chambers communicates with hydraulics so the piston are movable in response to the communicated hydraulics. A sleeve disposed in the housing is movable with the piston between first, second, and third positions. The sleeve can have a seat movable between two conditions for passing/engaging plugs. The sleeve in the first position closes off communication through the first and second ports, and the sleeve in the second position permits communication through the first port and closes off communication through the second port. The sleeve in the third position closes off communication through the first port and permits communication through the second port. The actuation mechanism is operable to communicate the hydraulics respectively with the chambers of the flow tools.

28 Claims, 6 Drawing Sheets

(51) Int. Cl.

| | |
|---|---|
| ***E21B 43/14*** | (2006.01) |
| *E21B 43/08* | (2006.01) |
| *E21B 43/26* | (2006.01) |
| *E21B 34/00* | (2006.01) |

(52) U.S. Cl.
CPC ..... *E21B 43/26* (2013.01); *E21B 2034/007* (2013.01)

(56) References Cited

U.S. PATENT DOCUMENTS

| | | | | |
|---|---|---|---|---|
| 8,291,982 | B2 | 10/2012 | Murray et al. | |
| 8,297,358 | B2 | 10/2012 | Korkmaz et al. | |
| 8,833,469 | B2 | 9/2014 | Purkis | |
| 9,574,421 | B1 * | 2/2017 | Saraya | E21B 34/14 |
| 2009/0056934 | A1 * | 3/2009 | Xu | E21B 43/26 166/244.1 |
| 2010/0200244 | A1 * | 8/2010 | Purkis | E21B 34/066 166/373 |
| 2015/0285063 | A1 | 10/2015 | Purkis | |

OTHER PUBLICATIONS

First Office Action in counterpart CA Appl. 2,958,700, dated Dec. 13, 2017, 4-pgs.

* cited by examiner

HYDRAULICALLY ACTUATED FLUID COMMUNICATION MECHANISM

CROSS-REFERENCE TO RELATED APPLICATIONS

This application claims the benefit of U.S. Provisional Appl. 62/299,525, filed 24 Feb. 2016, which is incorporated herein by reference.

BACKGROUND OF THE DISCLOSURE

As is well known, a production string of tubulars having a completion on its lower end can be inserted into a cased or uncased wellbore. The production string may be required for a number of reasons, including carrying produced fluid from production zones up to the surface of the wellbore.

Conventionally, the production string includes one or more completion tools, such as: a barrier in the form of a flapper valve or the like; a packer to seal the annulus between the completion string and the casing; and a circulation valve to selectively circulate fluid from out of the throughbore of the production tubing and into the annulus to flush fluids up the annulus and out of the wellbore. The production string may also include other completion tools, such as sand screen assemblies, gravel packing equipment, sliding sleeves, and the like.

The various completion tools downhole can be selectively activated in a number of ways. In one method, operators can use intervention equipment, such as tools run with an intervention rig into the production tubing on slickline to actuate the tools. In an alternative method, the completion and production string can be run into the cased wellbore with electrical cables that run from the various tools up the outside of the production string to the surface. In this way, power and control signals can be sent down the cables to the various tools.

Despite these methods, a completion apparatus is desirable that can reduce the requirements for either cables run from the downhole completion up to the surface and/or reduce the need for intervention to be able to actuate the various completion tools.

SUMMARY OF THE DISCLOSURE

According to the present disclosure, a completion apparatus for a wellbore comprises one or more completion or flow tools. In one particular arrangement, the apparatus includes plurality of flow tools and includes an actuation mechanism disposed downhole for operating the flow tools.

The flow tool comprises a housing, a piston, and a sleeve. The housing defines a throughbore and has a first (circulation) port and a second (production) port communicating the throughbore with the wellbore. The piston defines first and second chambers with the housing. The chambers communicate with hydraulics, and the piston is movable in response to the communicated hydraulics.

The sleeve is disposed in the throughbore and is movable with the piston between first, second, and third positions. The sleeve in the first (closed) position closes off communication through the circulation and production ports, whereas the sleeve in the second (circulation) position permits communication through the circulation port and closes off communication through the production port so circulation, treatment, or fracture operations can be performed. The sleeve in the third (production) position closes off communication through the circulation port and permits communication through the production port so production can be performed.

The apparatus can include a screen disposed on the apparatus adjacent the flow tool to screen fluid communication of produced fluids from the wellbore to the production port when the tool is configured for production. A flow control in the form of a nozzle, valve, or the like can be disposed on the apparatus in fluid communication between the screened fluid and the production port to control the flow of the screen fluid (i.e., change velocity, pressure, or flow rate of the produced fluid).

During operations to circulate treatment, the sleeve can be sequenced at least one time from the first (closed) position to the second (circulation) position and from the second (circulation) position back to the first (closed) position. To produce fluid, the sleeve can be sequenced at least one time from the first (closed) position to the third (production) position.

The flow tool can further include a seat disposed in the throughbore and movable with the sleeve between first (pass) and second (engage) conditions. For example, the seat in the pass condition is expanded to pass a given plug traveling through the throughbore of the flow tool, while the seat in the engage condition is contracted or restricted to engage a given plug traveling through the throughbore. Being movable with the sleeve, the seat has its different conditions based on the position of the sleeve. For example, the seat has the pass condition with the sleeve in the closed position. Thus, the seat having the pass condition with the sleeve in the closed position can pass any number of the given plug travelling through the throughbore. Alternatively, the seat has the engage condition with the sleeve in the circulation position so the seat can engage the given plug traveling through the throughbore and divert circulated fluid in the throughbore out the circulation port. Finally, the seat can have the pass condition with the sleeve in the production position to pass any number of plugs travelling through the throughbore.

In one configuration, the seat comprises a plurality of segments disposed about the throughbore and carried by the sleeve. The segments have the pass condition expanded into a first recess in the throughbore when the sleeve is in the closed and the production position, while the segments have the engage condition retracted in the throughbore when the sleeve is in the circulation position. As an alternative, the seat can include a split ring, dogs, or other components available in the art.

In one arrangement, the apparatus further comprises an actuation mechanism disposed on the apparatus and operable to communicate the hydraulics respectively with the first and second chambers of one or more of the flow tools. For example, the actuation mechanism can include at least one hydraulic source communicating the hydraulics, at least one detector receiving one or more communicated signals, and an electronic control in operable communication with the at least one detector. The electronic control can operate the at least one hydraulic source in response to the one or more received signals.

The at least one detector can be a wireless antenna and/or a pressure transducer. Meanwhile, the at least one hydraulic source can include at least one electric motor operating at least one hydraulic pump in fluid communication with at least one hydraulic fluid reservoir. At least one selector can be provided to selectively communicate the hydraulics of the at least one hydraulic source with a plurality of transmission lines for various flow tools of the completion apparatus.

According to the present disclosure, completing zones of a wellbore with a completion apparatus involves selecting any one of the zones. Each of the zones is associated with a flow tool of the completion apparatus. To select any one of the zones and open/close the tool's ports, signals can be received downhole at the completion apparatus, or a timer of the completion apparatus can be timed out.

For the selected zone, a circulation port is opened in the associated flow tool by actuating hydraulics of the completion apparatus. Fluid is then circulated from the circulation port to the wellbore for treatment, circulation, fracturing, or the like. After treatment, the circulation port is then closed in the associated flow tool by actuating the hydraulics of the completion apparatus.

At least one other completion operation can then be performed in the wellbore. For example, another zone can be selected for treatment in a comparable manner. Eventually, the flow tool can be configured for production by actuating the hydraulics of the completion apparatus to open a production port in the associated flow tool associated with the selected zone. During production, wellbore fluid can be screened into the production port through a screen associated with the associated flow tool.

To circulate the fluid from the circulation port to the wellbore, a deployed plug can be engaged at a seat of the associated flow tool to at least partially divert the circulated fluid from the circulation port. Then, closing the circulation port in the associated flow tool further can involve releasing the engaged plug from the seat.

Actuating the hydraulics of the completion apparatus can involve supplying the hydraulics to chambers of a piston of the associated flow tool to shift a sleeve opened/closed relative to the circulation port with the piston. Similarly, actuating the hydraulics of the completion apparatus to open the production port can involve supplying the hydraulics to one of the chambers of the piston to shift the sleeve open relative to the production port with the piston.

The foregoing summary is not intended to summarize each potential embodiment or every aspect of the present disclosure.

DETAILED DESCRIPTION OF THE DISCLOSURE

Figure 1:
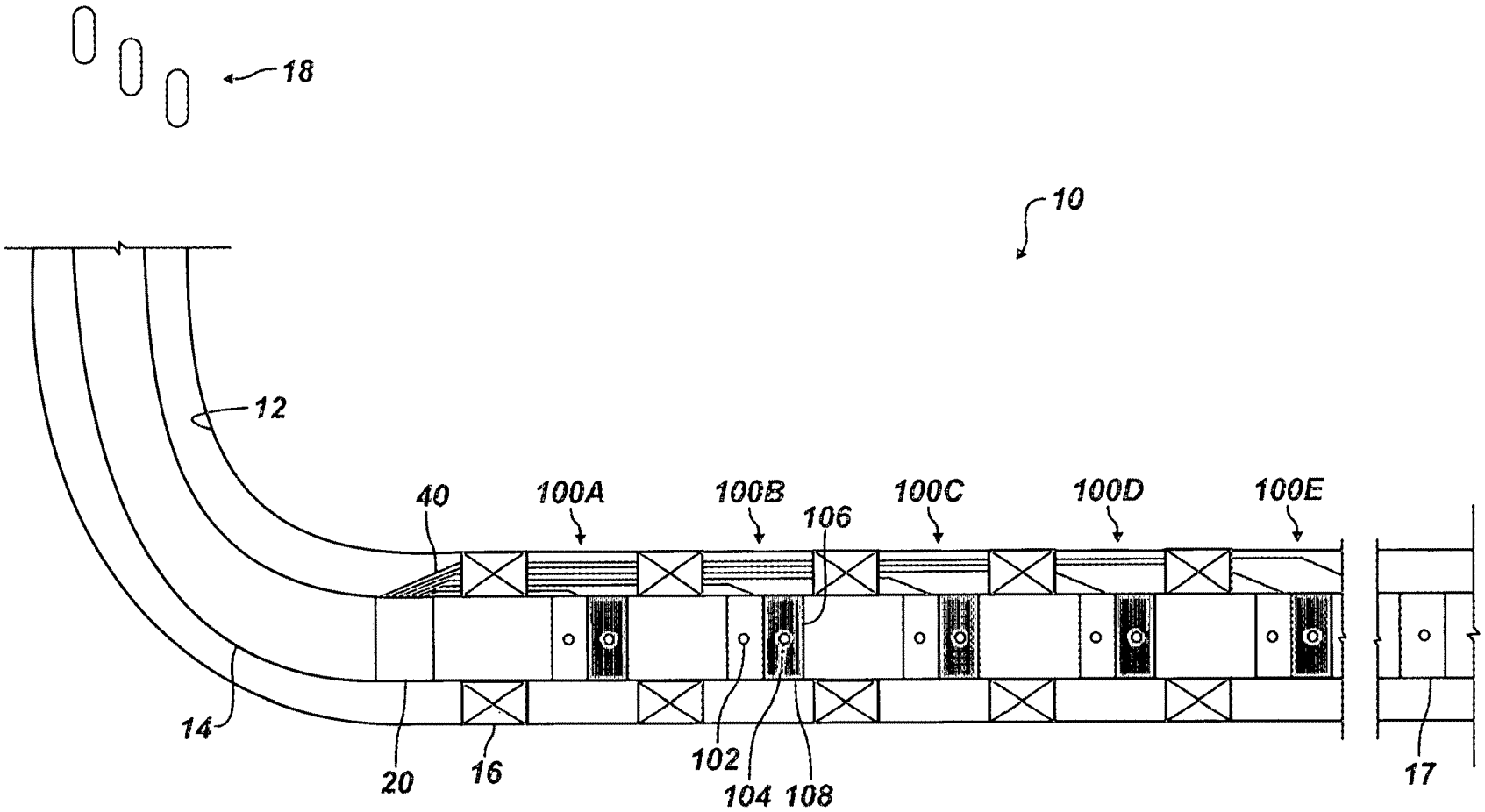
FIG. 1 illustrates a completion assembly according to the present disclosure disposed on a tubing string in a wellbore.

In completion systems, it can be advantageous to treat, circulate fluids, fracture, etc. various zones downhole in any desired sequence. Additionally, it can be advantageous to produce from various zones downhole in any desired sequence. As shown in FIG. 1, a production string 14 in a cased on uncased wellbore 12 has a completion assembly 10 according to the present disclosure disposed thereon. The completion assembly 10 allows operators to selectively treat various zones downhole in any desired sequence and/or to selectively produce various zones downhole in any desired sequence.

The completion assembly 10 includes an actuation mechanism 20 and includes a number of completion or flow tools 100A-E located along the production string 14 at various zones. Packers 16 may be located in the annulus of the wellbore 12 to isolate the zones from one another, and the completion assembly 10 may include a circulation valve 17, which may be in the form of a ball valve, a flapper valve, or a remotely actuated valve according to the present disclosure.

Each of the completion tools 100A-E includes a first (outlet or circulation) port 102, which may be used for circulation, facture, or other treatment of the surrounding zone. Each of the completion tools 100A-E also include a second (inlet or production) port 104, which may be used for production from the surrounding zone. As preferred, the inlet port 104 for the tools 100A-E may communicate with screens 106 for screening the produced fluid from the zone.

Internally and as discussed in more detail below, each of the completion tools 100A-E further includes a valve 108 selectively operable to open and close the outlet and inlet ports 102, 104 according to operations to be performed in the various zones. According to one arrangement detailed later with respect to FIGS. 2, 4A-4E, etc., this valve 108 includes a sleeve (110) movable by a hydraulic piston (130) between positions in the flow tool 100 to control the fluid communication. A seat (120) for a deployed plug, such as a ball, may also be provided and may also be selectively operable by movement of the sleeve (110).

During deployment, the completion assembly 10 is run in the wellbore 12 on the production string 14, which is made up of a number (which could be hundreds) of production tubulars having threaded connections. The completion assembly 10 is run into the wellbore 12 with the circulation valve 17 in the open configuration so fluid can flow in production string 14. The packers 16, if present, are run into the wellbore 12 in an unset configuration so they do not seal in the annulus. Additionally, the completion tools 100A-E are run in a closed configuration in which the ports 102, 104 are closed by the respective valves 108.

Once deployed in the wellbore 12, the production string 14 may be pressure tested, and the packers 16 may then be set. These steps may involve opening/closing the circulation valve 17, pressuring up the production string 14, and/or actuating the packers 16. These steps can be achieved in a number of ways. For example, a ball may be dropped down the production string 14 to close off the valve 17 so built-up tubing pressure can set the packers 16. Alternatively, tags 18 can be inserted into fluid at the surface of the wellbore 12 and can be pumped down through the production string 14 to the completion assembly 10. The tags 18 can be coded at the surface with instructions to tell the actuation mechanism 20 to actuate the circulation valve 17, set the packers 16, etc. Also, if fluid flow is not available through the production string 14 during various stages, pressure signals instead of tags 18 can be sent downhole from the surface to the actuation mechanism 20 to sense the pressure signals in the fluid within the string 14 and to then actuate the circulation valve 17, set the packers 16, etc.

Once the completion assembly 10 is properly set, various treatment and production operations can be selectively performed. In the assembly 10 of FIG. 1, for example, the actuation mechanism 20 selectively controls operation of the various completion or flow tools 100A-E by actuating the valves 108 to selectively open/close the inlet/outlet ports 102, 104. Various types of actuation mechanism can be used in the assembly 10, including, but not limited to, hydraulic mechanisms, electric motors, control line manifolds, etc. Moreover, even though the assembly 10 in FIG. 1 is shown having an actuation mechanism 20 downhole, various teachings of the present disclosure can be applicable to other arrangements, such as having actuation components at surface and communicating downhole via conduits, cables, or the like.

The actuation mechanism 20 can be controlled from the surface using a number of techniques, including, but not limited to, pressure pulse telemetry, electrical communication through wired lines, wirelessly using RFID tags, etc. In one particular embodiment, the actuation mechanism 20 is a wireless remote control central power unit similar to what is disclosed in U.S. Pat. No. 8,833,469 and its related co-pending application U.S. Pub. 2015/0285063, which are incorporated herein by reference in their entirety.

A control transmission 40 is shown schematically in FIG. 1 as leading from the actuation mechanism 20 to each of the completion tools 100A-E. Depending on the actuation mechanism 20 used, the control transmissions 40 may be in the form of electrical cables, hydraulic control lines, etc. As will be described subsequently, the control transmissions 40 are preferably in the form of conduits capable of transmitting hydraulic fluid from the actuation mechanism 20 to (and from) the hydraulic pistons (130) of the valves 108 in each of the completion tools 100A-E. These conduits can be external, internal, or both to the assembly 10.

Figure 2:
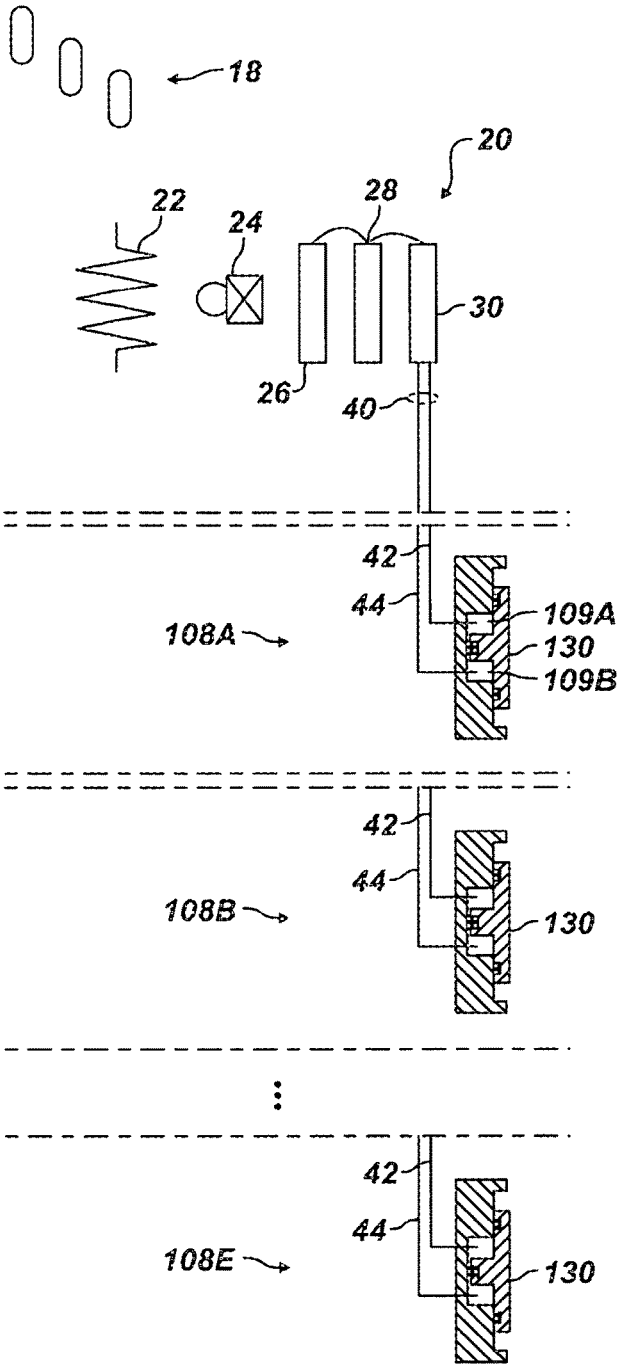
FIG. 2 schematically illustrates components of an actuation mechanism and other components of the completion assembly.

In one arrangement, signals in the form of one or more tags 18, pressure pulses, etc. coded at surface with predetermined instructions can be introduced into the fluid flow for the actuation mechanism 20 to actuate various ones of the flow tools 100A-E (and the circulation tool 17 and packers 16 if applicable). Features of the actuation mechanism 20 in the form of a wireless remote control central power unit are schematically shown in FIG. 2. The mechanism 20 includes an RFID tag detector 22 having an antenna to detect signals sent from the surface. The signals are coded onto RFID tags 18 at the surface by operators and then deployed through the tubing string (14) to the mechanism 20. In addition or in the alternative, a pressure signature detector 24 with a pressure transducer or the like can be used to detect peaks in fluid pressure in the tubing string (14) applied at the surface by the operators to provide a second way for the operators to send signals downhole to the mechanism 20.

A battery pack 26 is provided if direct electrical communication with the surface is not provided. The battery package 26 may thereby provide all the power requirements to the mechanism 20. An electronics package 28 with an electronic control and memory has stored information coded at the surface by the operators with the instructions for selection of which completion tools 100A-E to operate depending upon what signals are received by one of the two receivers 22, 24. The electronics package 26 may also include one or more timers for initiating operations after a period of time.

In response to signals, timers or the like, the actuation mechanism 20 uses hydraulic power to selectively operate the selected completion tools 100A-E. Accordingly, one or more hydraulic sources 30 having electrical motor and hydraulic pump combinations can be operated to control the opening and closing of one or more of the flow tools 100A-E.

Figure 3A:
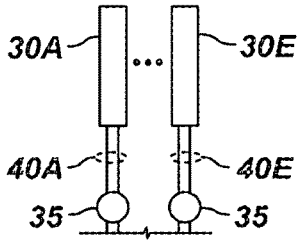
FIGS. 3A-3D schematically illustrate arrangements of connecting one or more hydraulic sources to components of the completion assembly.
Figure 3B:
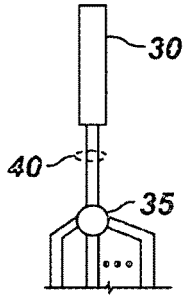

As shown in FIG. 3A, separate motor/pump combinations 30A-E can be connected to each tool 100A-E. Each pair of transmission lines 40A-E can have a selector or valve 35 for selecting which of the lines is pressurized and which is vented to control movement of the respective piston (130). Alternatively as shown in FIG. 3B, one motor/pump combination 30 can connect to multiple tools 100A-E via one or more selectors or valves 35 for selectively directing the hydraulic communication as appropriate. The one or more selectors or valves 35 can switch which of the tools 100A-E is to receive hydraulics and/or can switch which of the conduits 42, 44 can be pressurized and which one can be vented.

Figure 3C:
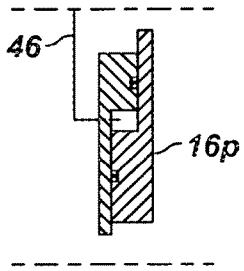
Figure 3D:
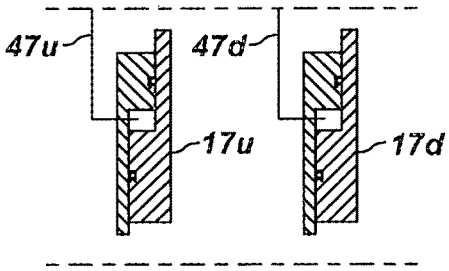

As noted, other tools of the completion assembly 10 besides the flow tools 100A-E can be actuated by the actuation mechanism 20. For example, FIG. 3C shows how a piston 16*p* for a packer (16: FIG. 1) can be connected by a conduit 46 from the one or more motor/pump combination 30 to actuate the packer (16). Also, FIG. 3D shows how pistons 17*u*, 17*d* for a circulation valve (17: FIG. 1) can be connected by conduits 47*u*, 47*d* from the one or more motor/pump combination 30 to open/close the valve (17).

As depicted in FIG. 2, the one or more motor/pump combinations 30 has at least two hydraulic fluid outlets 42, 44 for the transmission 40 that are respectively used to provide hydraulic pressure to hydraulic chambers 109A-B within the valve 108 of the flow tool (100). The hydraulic fluid conduits 42, 44 for the transmission 40 are arranged to shift the piston 130 and the sleeve (110) in the tool (100) in one direction when hydraulic fluid is pumped into one chamber 109A and to shift the piston 130 and the sleeve (110) in the tool (100) in an opposite direction when hydraulic fluid is pumped into the other chamber 109B.

To operate a given one of the completion tools 100A-E with circulation being possible, one or more pre-programmed RFID tags 18 dropped or flushed into the completion string (14) eventually reach the actuation mechanism 20. The tag 18 then transmits certain radio frequency signals, enabling it to communicate with the mechanism's antenna 22. This data is then processed by the electronics package 28. As an example, the RFID tag 18 may have been programmed at the surface by the operators to transmit information instructing the mechanism 20 to open the outlet port (102) on one of the given flow tools (100A-E) to commence treatment of the associated zone. (As noted, a pressure signal can be used to communicate with the mechanism's pressure detector 24.)

The electronics package 28 processes the data and instructs the motor/pump combination 30 powered by battery pack 26 to drive a hydraulic piston pump (not shown). Hydraulic fluid is then pumped through one of the hydraulic conduits 42, 44 to the piston 108 of the selected tool (100A-E) to shift the tool's sleeve (110). Fluid exits the piston 108 through the other hydraulic conduit 44, 42 for return to a hydraulic fluid reservoir (not shown) of the motor/pump combination 30. This action results in the shifting of the sleeve (110) to open fluid communication through the circulation port (102). Continued operation of opening/closing ports (102, 104) on this and other of the flow tools (100A-E) can follow comparable steps.

With an understanding of the overall completion assembly 10, discussion now turns to FIGS. 4A-4E, which show cross-sectional views of a flow tool 100 according to the present disclosure in different stages of operation.

The tool 100 includes a housing 101, which may comprise several components to facilitate assembly. As noted above, the tool 100 has a valve 108 that can selectively control fluid communication through outlet ports 102 and inlet ports 104. The outlet ports 102 defined in the housing 101 can be circulation ports for communicating fracture fluid or other treatment out of the tool 100. The inlet ports 104 defined in the housing 101 can be production ports that communicate fluid passing from the wellbore through a screen 106 and nozzle 107 into the tool 100.

As noted above, the valve 108 includes a sleeve 110 movable in the bore of the housing 101 by operation of a piston 130. Fluid communicated via conduits 142, 144 in the housing 101 communicate with opposing sides of the piston 130, which moves the sleeve 110 in opposing directions in the housing 101. These conduits 142, 144 communicate with the actuation mechanism (20: FIG. 2) via control lines, passages, etc. running along the completion assembly (10).

The sleeve 110 includes openings 112 for aligning or misaligning with the circulation ports 102 on the housing 101. The sleeve 110 further includes openings 114 for aligning or misaligning with the production ports 104 on the housing 101. The sleeve 110 is movable with the piston 130 between first, second, and third positions. For example, the sleeve 110 in the first position (FIGS. 4A, 4D) closes off communication through the circulation and production ports 102, 104. The sleeve 110 in the second position (FIGS. 4B-4C) permits communication through the circulation ports 102 and closes off communication through the production ports 104. Finally, the sleeve 110 in the third position (FIG. 4E) closes off communication through the circulation ports 102 and permits communication through the production ports 104.

Finally, a seat 120 is disposed on the sleeve 110 and is movable therewith between a pass (retracted) condition and an engage (contracted) condition depending on the position of the sleeve 110 in the housing 101. As shown in the current arrangement, the seat 120 can be segmented having dogs or segments 122 that contract and retract relative to one another depending and on the location of the dogs or segments 122 relative to recesses 105A-B in the housing's bore. The tool 100 can use other types of seats, such as a split C-ring seat that expands and contracts, segments having interstitial elastomer to prevent a buildup of material, etc. Accordingly, the seat 120 can have any other suitable structure.

The seat 120 in the pass condition is expanded to pass a plug P traveling through the tool 100, whereas the seat 120 in the engage condition is restricted to engage a traveling plug P. As shown, the seat 120 has the pass condition with the sleeve 110 in the first, closed position (FIGS. 4A, 4D) and the third, production position (FIG. 4E), whereas the seat 120 has the engage condition with the sleeve 110 in the second, circulation position (FIGS. 4B-4C).

Figure 6:
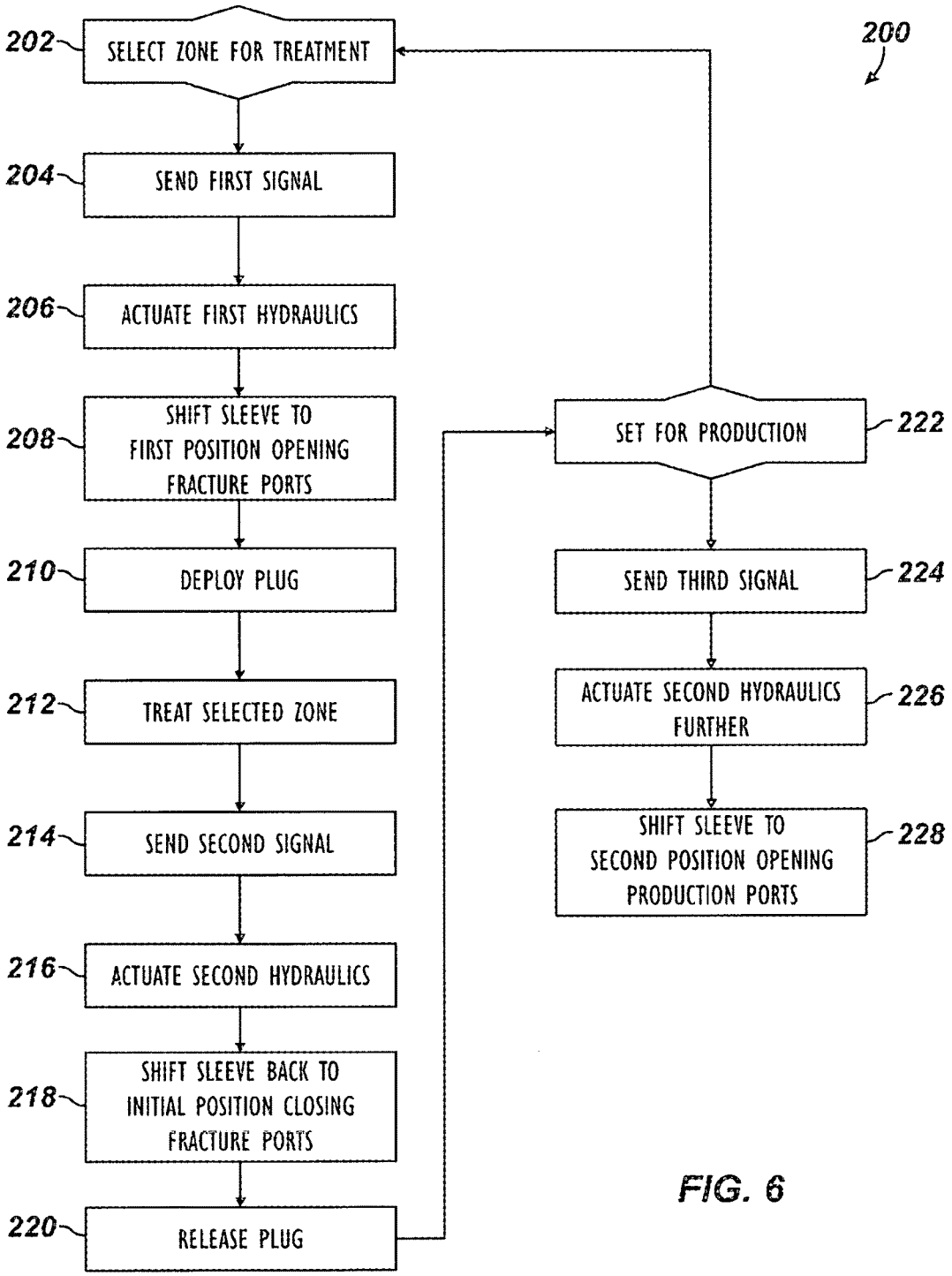
FIG. 6 illustrates an example of some operational steps for the disclosed completion assembly.

Operation of the completion tool 100 in FIGS. 4A-4E will now be discussed with reference to FIG. 6, which outlines some of the operational steps 200 for operating the flow tool 100.

Figure 4A:
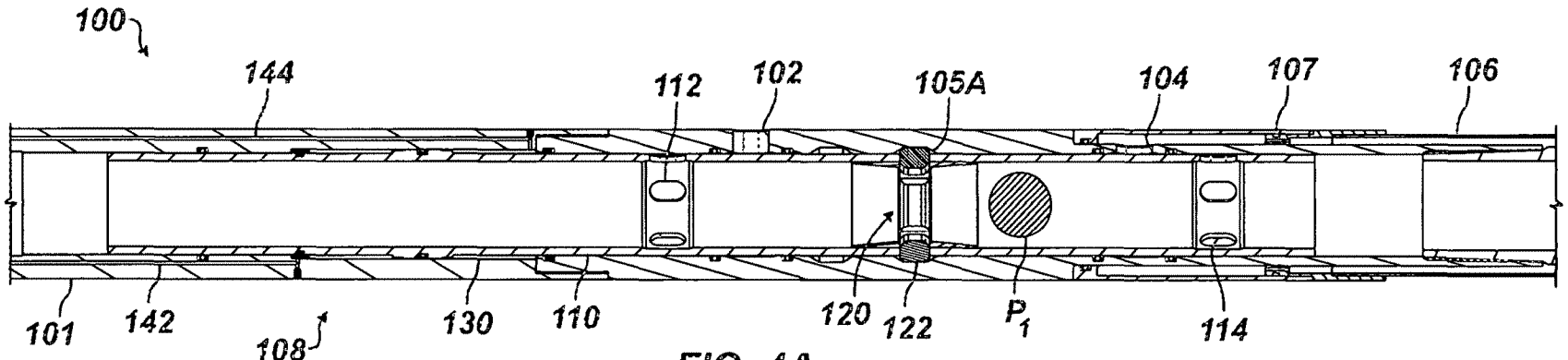
FIGS. 4A-4E illustrate an embodiment of a completion tool of the disclosed assembly in cross-sectional views at different stages of operation.
Figure 4B:
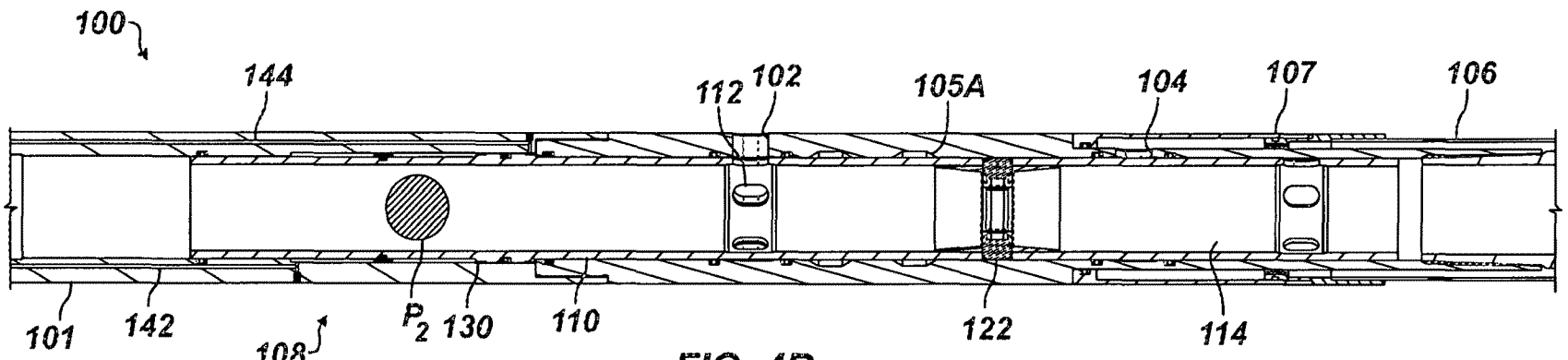
Figure 4C:
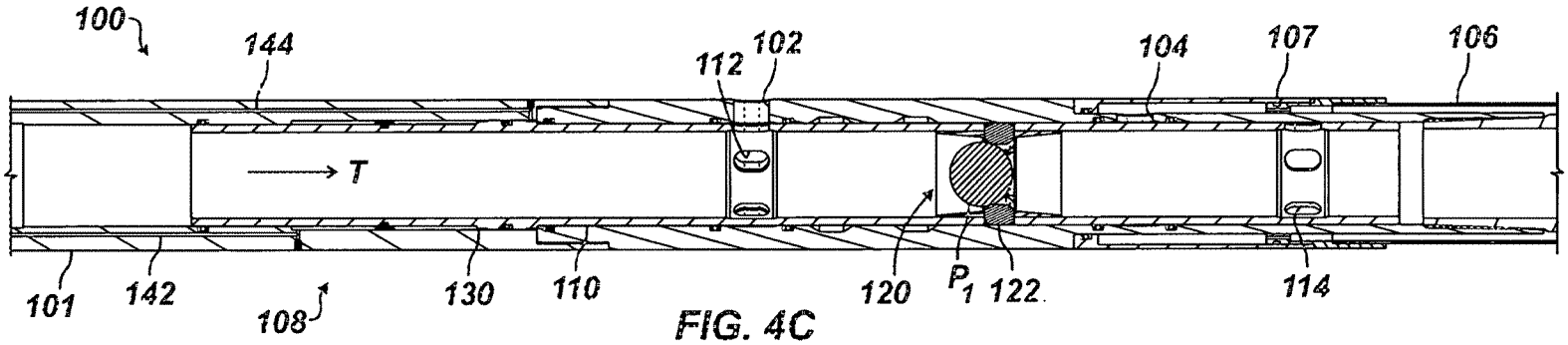

After run in, the flow tool 100 is in a first, closed condition as shown in FIG. 4A in which the sleeve 100 maintains the circulation ports 102 closed, the production ports 104 closed, and the seat 120 in a retracted, pass condition. Plugs $P_1$, balls, tools, RFID tags (18), etc. can pass and flow through the tool 100 on their way to lower zones. In fact, the seat 120 having the pass (retracted) condition with the sleeve 110 in the first, closed position can pass any number of the plugs $P_1$ travelling through the tool 100, which may be used for other completion operations.

When circulation or fracturing is set to occur at a selected zone (Decision 202), a first signal is sent from the surface (Block 204), first hydraulics are actuated (Block 206), and the sleeve 110 of the selected tool 100 is sequenced or shifted from the closed position to the second, circulation position (FIG. 4B) opening the circulation ports 102 (Block 208).

For example, the actuation mechanism (20) discussed previously is initiated by a signal, trigger, timer, RFID tag (18), pressure pulse, or the like being deployed down the tubing string (14). The hydraulic pressure unit of the actuation mechanism (20) pressures up the first hydraulic line 142 for the selected tool 100 to a first pressure level. (The second hydraulic line 144 may be vented to the reservoir of the mechanism (20) or elsewhere.) The build-up pressure in the piston 130 of the tool 100 then shifts the sleeve 110 to a first opened condition, as shown in FIG. 4B, opening the circulation ports 102 on the tool 100.

As shown, the sleeve 110 aligns its set of circulation openings 112 with the circulation ports 102 so that fluid communication is permitted between the tool's bore and the wellbore. In this shift of the sleeve 110, the seat 120 is moved from the pass condition to the engage condition suited for catching a plug, such as a later deployed plug $P_2$. As shown, the seat 120 can have a number of segments 122 that reside in a recess 105A of the tool's bore when in the pass condition (FIG. 4A) and that ride on the inner surface of the tool's bore to be in the engage condition (FIG. 4B).

As shown in FIGS. 4B-4C, a plug P2 can then be deployed to engage the contracted seat 120 (Block 210). In this way, fluid flow down the tubing string (14) can be diverted out through the open circulation ports 102 on the tool 100 to treat the selected zone while the plug $P_2$ in the seat 120 at least partially prevents fluid communication of the treatment T further downhole. Shifting of the sleeve 110 by the deployed plug $P_2$ on the seat 120 is not necessary for operation of the tool 100. However, should the seating of the plug $P_2$ on the seat 120 be needed at least partially for moving the sleeve 110, then it can be used for that purpose as well.

Figure 4D:
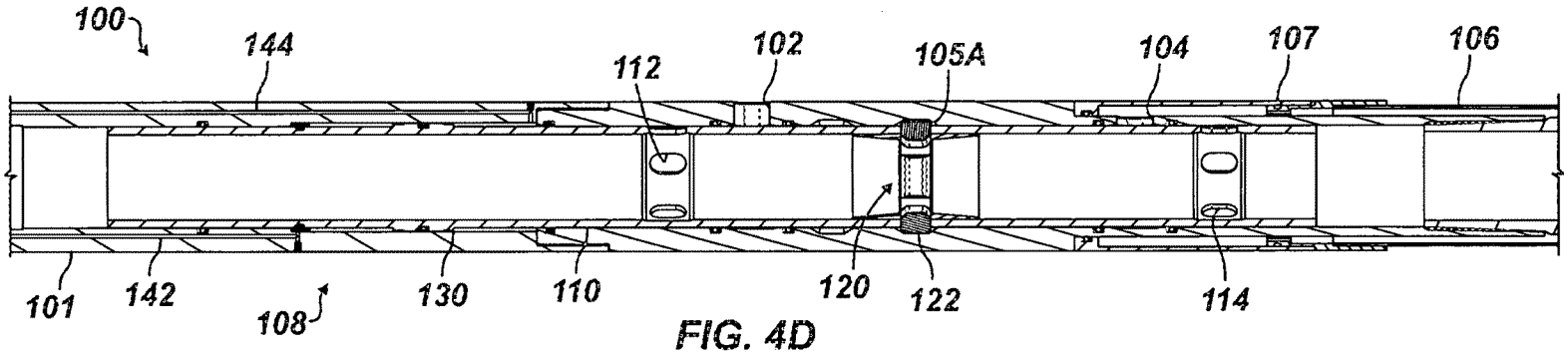

The selected zone can now been treated (fractured) by pumping the treatment fluid T down the tubing string (14) and diverting the treatment to the zone through the opened tool 100 (Block 212). After the treatment (fracture) operation, a second signal is sent from the surface (Block 214), second hydraulics are actuated (Block 216), and the sleeve 110 of the selected tool 100 is sequenced or shifted from the circulation position back to the initial closed position, as shown in FIG. 4D, closing the circulation ports 102 (Block 218). The previously seated plug $P_2$ is then released to travel further downhole. (Use of this plug $P_2$ may be completed, or it may travel to another completion tool 100 or the like.)

To sequence the sleeve 110, for example, the actuation mechanism (20) discussed previously is initiated by a second signal, trigger, or the like. For this and any other signaling disclosed herein, a telemetry pressure pulse, a second RFID tag (18), timer, or other form of transmission may be used. Depending on whether circulation is available, an RFID tag (18) can be deployed down the tubing string (14) to provide the second signal. Otherwise, if circulation is not available, then the pressure pulse telemetry or timer can be used.

In response to the second signal, the hydraulic pressure unit of the actuation mechanism (20) pressures up the second hydraulic line 144 for the selected tool 100 to a first pressure level. (The first hydraulic line 142 can be vented.) The built-up pressure on the opposing side of the piston 130 of the tool 100 then shifts the sleeve 110 from the second position back to its initial closed condition closing the circulation ports 102 on the tool 100.

The actuation mechanism (20) can control the shifting so that the sleeve 110 does not shift past the closed position. Also, a feature on the tool 100 can prevent further shifting of the sleeve 110 beyond the initial position. For example, a dog, catch, or temporary lock can engage when the sleeve 110 shifts back to the initial closed position so that the built-up pressure does not shift the sleeve 110 past this initial position. As noted below, a shearable device, such as shear ring, shear pins, etc., on the piston 130 can engage a shoulder in the chamber 109 to prevent further movement of the sleeve 110.

As shown in FIG. 4D, the sleeve 110 misaligns its set of openings 112 with the circulation ports 102 so that fluid communication is not permitted between the tool's bore and the wellbore. In this shift of the sleeve 110, the seat 120 is moved back to its initial pass condition in the recess 105A for releasing and passing the previously seated plug $P_2$. At this point, other stages can be actuated and treated, and any deployed plugs can be allowed to pass through the tool 100.

At any point, this completion tool 100 can be again shifted from this closed position (FIG. 4D) to the circulation position (FIGS. 4B-4C) to perform additional treatment or other operation if desired. In this sense, the sleeve 110 can be sequenced one or more times from the closed position to the circulation position and from the circulation position back to the closed position.

At some point during operations, the given zone along with any other zones may be set for production (Decision 222). A third signal is sent from the surface (Block 224), the second hydraulics are actuated (Block 226), and the sleeve 110 of the selected tool 100 is sequenced or shifted to the third, production position (FIG. 4E) closing the circulation ports 102 and opening the production ports 106 (Block 208).

Figure 4E:
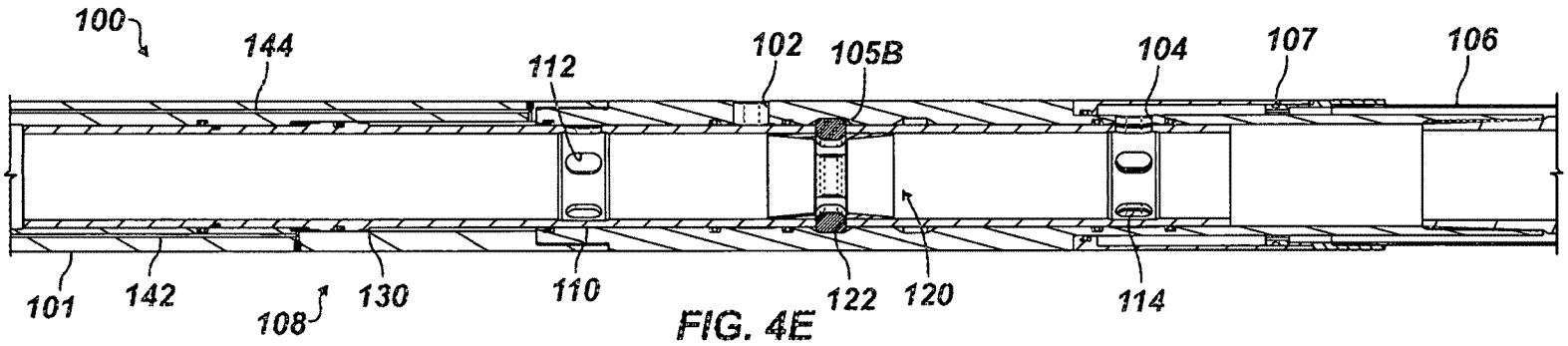

For example, the actuation mechanism (20) discussed previously is initiated by a third signal, trigger, or the like, such as a third RFID tag (18) being deployed down the tubing string (14). The hydraulic pressure unit of the actuation mechanism (20) pressures up the second hydraulic line 144 for the selected tool 100 to a second pressure level. (The first hydraulic line 142 can be vented.) The built-up pressure on the opposing side of the piston 130 of the tool 100 then shifts the sleeve 110 to the third opened condition, as shown in FIG. 4E, opening the production ports 104 and closing the circulation ports 102 on the tool 100.

As shown, the sleeve 110 aligns its set of production openings 114 with the production ports 104 so that fluid communication is permitted between the tool's bore and the screen 106, which can have inflow controls, such as a nozzle 107, check valve, etc. In this shift of the sleeve 110, the seat 120 is moved from its initial pass condition to a subsequent pass condition in another recess 105B for releasing and passing deployed plug(s). At this point, other stages can be actuated, and any deployed plugs can be allowed to pass through the tool 100.

Although the completion tool 100 is described here as being particularly sequenced from the first (closed) position to the second (circulation) position, back to the first (closed) position, and then to the third (production) position, such a sequence is not strictly necessary, especially if treatment or circulation is not required for the zone. Accordingly, it is possible for the tool 100 to be operated from the outset from the first (closed) position (FIG. 4A) directly to the third (production) position (FIG. 4E). Even then, the tool 100 can be further sequenced to any of the other positions to close the ports 102, 104 and to only open the circulation ports 104.

Although the recess 105B can be provided for the seat 120 to retract, an alternative arrangement of the tool 100 may instead lack such a recess 105B. Instead, the seat 120 can have the engage condition while the sleeve 110 is in the production position. This arrangement may allow a plug (not shown) to be deployed to the tool 100 to engage the seat 120, which may have a number of purposes, such as closing off fluid flow further downhole, shifting the sleeve 110, or the like.

Figure 5A:
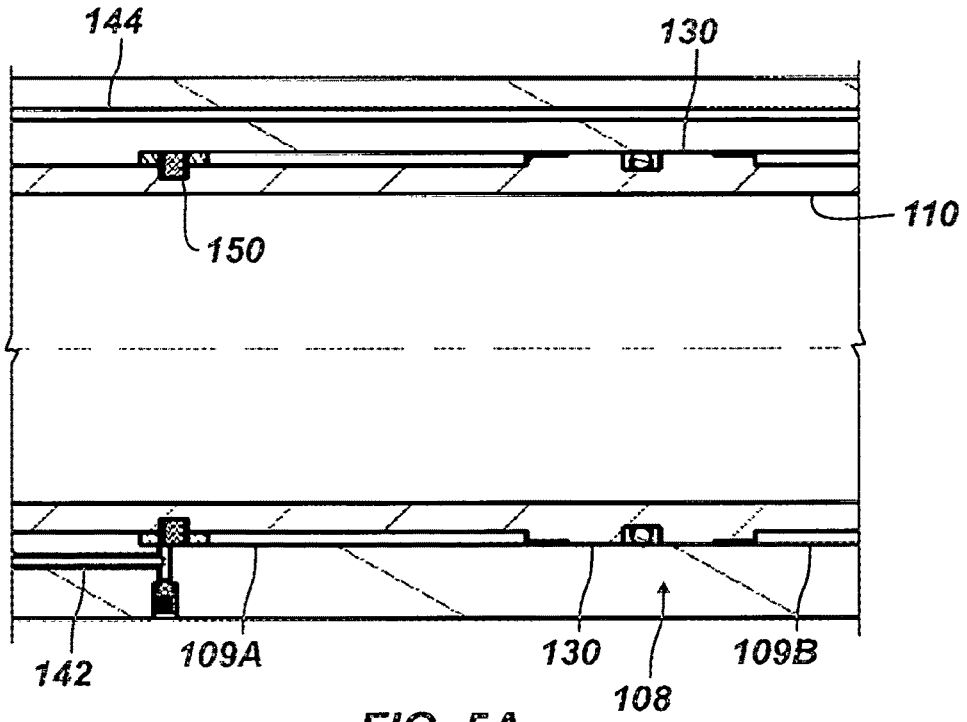
FIGS. 5A-5B illustrate detailed cross-sectional views of the piston for the disclosed tool.
Figure 5B:
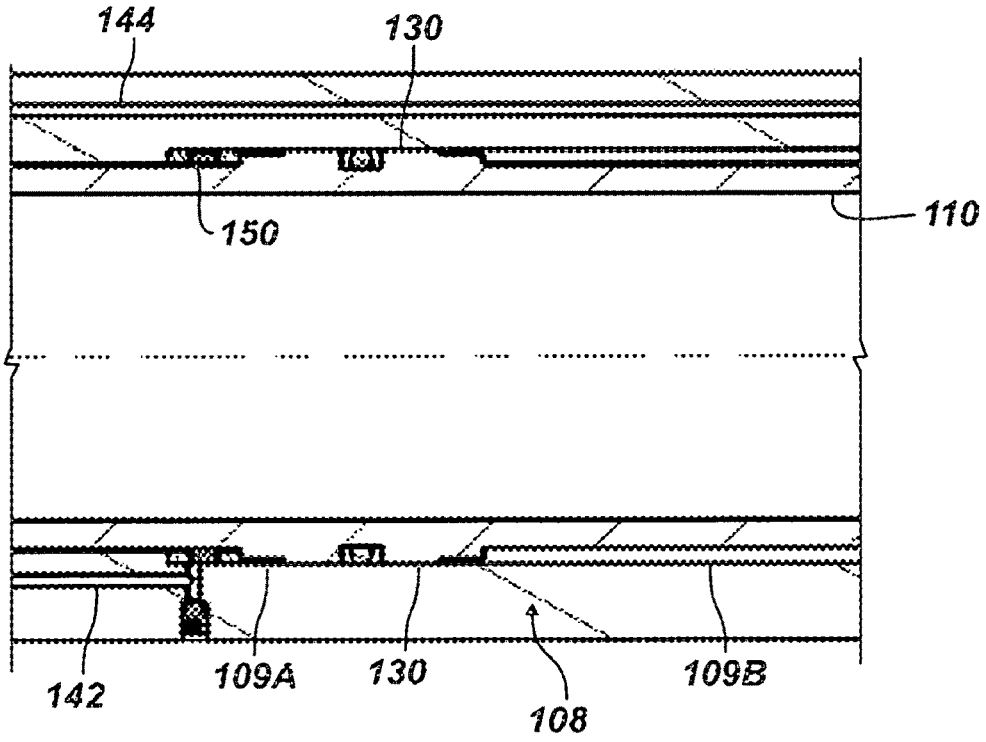

To shift the sleeve 110 from the closed position to the production position (FIG. 4E), the second pressure level can shear a retaining feature on the sleeve 110, which may be present to prevent premature opening of the production ports 104 when pressures are applied to the piston 130 for the reclosing stages of the operation in FIG. 4D. For example, FIGS. 5A-5B show details of the piston 130. A shearable device 150, such as a shear ring, pins, or the like, are disposed on the piston 130 and travel with it. When the piston 130 is actuated to return the sleeve 110 from the circulation position to its initial closed position, the shearing device 150 engages an upper shoulder in the upper chamber 109A. The first pressure level on the piston 130 used to return the sleeve 110 is not designed to shear the device 150, which holds back the piston 130.

The second pressure level on the piston 130, however, used to move the sleeve 110 into the production position that uncovers the production ports (104) is set to shear the device 150. For example, FIG. 5B shows the piston 130 having shifted to the sleeve 110 to the production position by shearing the device 150. The second pressure level can be about 3000-psi, although any other configuration can be used depending on the implementation.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the disclosed subject matter. Therefore, it is intended that the disclosed subject matter include all modifications and alterations to the full extent that they come within the scope of the disclosed embodiments, combinations, and the equivalents thereof.

What is claimed is:

1. A completion apparatus for a wellbore, the apparatus comprising a first flow tool, wherein the first flow tool comprises:

a housing defining a throughbore, the housing having first and second ports communicating the throughbore with the wellbore;

a piston defining first and second chambers with the housing, the first and second chambers communicating with hydraulics, the piston movable in response to the hydraulics communicated to the first and second chambers;

a sleeve disposed in the throughbore and movable with the piston between first, second, and third positions, the sleeve having first and second circulation openings, the sleeve in the first position closing off communication through the first and second ports, the sleeve in the second position permitting communication with the first circulation opening through the first port and closing off communication through the second port, the sleeve in the third position closing off communication through the first port and permitting communication with the second circulation opening through the second port; and a seat disposed in the sleeve between the first and second circulation openings and movable with the sleeve between first and second conditions, the seat in the first condition configured to pass a given plug traveling through the throughbore, the seat in the second condition configured to engage another given plug traveling through the throughbore.

2. The apparatus of claim 1, further comprising a screen disposed on the apparatus adjacent the first flow tool and screening fluid communication from the wellbore to the second port.

3. The apparatus of claim 2, further comprising a flow control disposed on the apparatus in fluid communication between the screened fluid and the second port, the flow control controlling the flow of the screened fluid.

4. The apparatus of claim 1, wherein the sleeve is sequenced at least one time from the first position to the second position and from the second position back to the first position.

5. The apparatus of claim 4, wherein the sleeve is further sequenced at least one time from the first position to the third position.

6. The apparatus of claim 1, wherein the seat has the first condition with the sleeve in the first position; and wherein the seat has the second condition with the sleeve in the second position.

7. The apparatus of claim 6, wherein the seat has the first condition with the sleeve in the third position.

8. The apparatus of claim 6, wherein the seat having the first condition with the sleeve in the first position passes any number of the given plug travelling through the throughbore.

9. The apparatus of claim 6, wherein the seat having the second condition with the sleeve in the second position engages the given plug traveling through the throughbore and diverts circulated fluid in the throughbore out the first port.

10. The apparatus of claim 9, wherein the sleeve sequenced from the second position back to the first position releases the given plug.

11. The apparatus of claim 6, wherein the seat having the first condition with the sleeve in the third position passes any number of the plug travelling through the throughbore.

12. The apparatus of claim 1, wherein the seat comprises a plurality of segments disposed about the throughbore and carried by the sleeve, the segments having the first condition expanded into a first recess in the throughbore with the sleeve in the first position, the segments having the second condition contracted in the throughbore with the sleeve in the second position, the segments having the first condition expanded into a second recess in the throughbore with the sleeve in the third position.

13. The apparatus of claim 1, further comprising an actuation mechanism disposed on the apparatus and operable to communicate the hydraulics with the first and second chambers of the first flow tool.

14. The apparatus of claim 13, wherein the actuation mechanism comprises:

at least one hydraulic source communicating the hydraulics;

at least one detector receiving one or more communicated signals; and an electronic control in operable communication with the at least one detector and operating the at least one hydraulic source in response to the one or more communicated signals received.

15. The apparatus of claim 14, wherein the at least one detector comprises at least one of a wireless antenna and a pressure transducer.

16. The apparatus of claim 14, wherein the at least one hydraulic source comprises at least one electric motor operating at least one hydraulic pump in fluid communication with at least one hydraulic fluid reservoir.

17. The apparatus of claim 16, wherein the actuation mechanism further comprises at least one selector operable to selectively communicate the hydraulics of the at least one hydraulic source with a plurality of transmission lines.

18. The apparatus of claim 13, further comprising at least one second flow tool comprising a second housing, a second piston, and a second sleeve, the actuation mechanism operable to communicate the hydraulics respectively with the first and at least one second flow tools.

19. The apparatus of claim 13, further comprising a packer disposed on the apparatus and operable with the hydraulics from the actuation mechanism.

20. A completion apparatus for a wellbore, the apparatus comprising a first flow tool, wherein the first flow tool comprises:

a housing defining a throughbore, the housing having first and second ports communicating the throughbore with the wellbore;

a piston defining first and second chambers with the housing, the first and second chambers communicating with hydraulics, the piston movable in response to the hydraulics communicated to the first and second chambers;

a sleeve disposed in the throughbore and movable with the piston between first, second, and third positions, the sleeve having first and second circulation openings, the sleeve in the first position closing off communication through the first and second ports, the sleeve in the second position permitting communication with the first circulation opening through the first port and closing off communication through the second port, the sleeve in the third position closing off communication through the first port and permitting communication with the second circulation opening through the second port; and a seat disposed in the sleeve between the first and second circulation openings and movable with the sleeve between a first passable condition, a catch condition, and second passable condition, the seat being in the first passable condition with the sleeve in the first position and being configured to pass a given plug traveling through the throughbore, the seat being in the catch condition with the sleeve in the first position and being configured to engage another given plug traveling through the throughbore, the seat being in the second passable condition and being configured to pass a given plug traveling through the throughbore.

21. The apparatus of claim 20, further comprising:

a screen disposed on the apparatus adjacent the first flow tool and screening fluid communication from the wellbore to the second port; and a flow control disposed on the apparatus in fluid communication between the screened fluid and the second port, the flow control controlling the flow of the screen fluid.

22. The apparatus of claim 20, wherein the sleeve is sequenced at least one time from the first position to the second position and from the second position back to the first position; and wherein the sleeve is further sequenced at least one time from the first position to the third position.

23. The apparatus of claim 20, wherein the seat having the catch condition with the sleeve in the second position engages the given plug traveling through the throughbore and diverts circulated fluid in the throughbore out the first port; and wherein the sleeve sequenced from the second position back to the first position changes the seat from the catch condition to the first passable condition releasing the given plug.

24. The apparatus of claim 20, wherein the seat comprises a plurality of segments disposed about the throughbore and carried by the sleeve, the segments having the first passable condition expanded into a first recess in the throughbore with the sleeve in the first position, the segments having the catch condition contracted in the throughbore with the sleeve in the second position, the segments having the second passable condition expanded into a second recess in the throughbore with the sleeve in the third position.

25. The apparatus of claim 20, further comprising an actuation mechanism disposed on the apparatus and operable to communicate the hydraulics with the first and second chambers of the first flow tool.

26. The apparatus of claim 25, further comprising at least one second flow tool comprising a second housing, a second piston, and a second sleeve, the actuation mechanism operable to communicate the hydraulics respectively with the first and at least one second flow tools.

27. The apparatus of claim 25, further comprising a packer disposed on the apparatus and operable with the hydraulics from the actuation mechanism.

28. A completion apparatus for a wellbore, the apparatus comprising a first flow tool, wherein the first flow tool comprises:

a housing defining a throughbore, the housing having first and second ports communicating the throughbore with the wellbore;

a piston defining first and second chambers with the housing, the first and second chambers communicating with hydraulics, the piston movable in response to the hydraulics communicated to the first and second chambers;

a sleeve disposed in the throughbore and movable with the piston between first, second, and third positions, the sleeve in the first position closing off communication through the first and second ports, the sleeve in the second position permitting communication through the first port and closing off communication through the second port, the sleeve in the third position closing off communication through the first port and permitting communication through the second port; and a seat disposed in the throughbore and movable with the sleeve between a first passable condition, a catch condition, and second passable condition, the seat being in the first passable condition with the sleeve in the first position and being configured to pass a given plug traveling through the throughbore, the seat being in the catch condition with the sleeve in the first position and being configured to engage a second given plug traveling through the throughbore, wherein the seat in the catch position engaged with the given plug diverts circulated fluid in the throughbore out the first port, wherein the sleeve sequenced from the second position back to the first position changes the seat from the catch condition to the first passable condition releasing the second given plug, the seat being in the second passable condition and being configured to pass a third given plug traveling through the throughbore.

* * * * *